US008670689B2

(12) United States Patent
Xie et al.

(10) Patent No.: US 8,670,689 B2
(45) Date of Patent: Mar. 11, 2014

(54) PROCESSING CARTRIDGE

(75) Inventors: Kui Xie, Guangdong (CN); Lianjun Wu, Guangdong (CN); Qingfei Peng, Guangdong (CN)

(73) Assignee: Zhuhai Seine Technology Limited, Zhuhai, Guangdong (CN)

( * ) Notice: Subject to any disclaimer, the term of this patent is extended or adjusted under 35 U.S.C. 154(b) by 357 days.

(21) Appl. No.: 12/724,539

(22) Filed: Mar. 16, 2010

(65) Prior Publication Data

US 2011/0229190 A1 Sep. 22, 2011

(51) Int. Cl.

| | |
|---|---|
| ***G03G 21/16*** | (2006.01) |
| ***G03G 15/08*** | (2006.01) |
| ***G03G 15/00*** | (2006.01) |
| ***G03G 21/00*** | (2006.01) |

(52) U.S. Cl.
USPC ..... 399/111; 399/106; 399/109; 399/358

(58) Field of Classification Search
USPC ..... 399/103, 106, 109, 111, 113, 358, 123
See application file for complete search history.

(56) References Cited

U.S. PATENT DOCUMENTS

| | | | | |
|---|---|---|---|---|
| 5,349,425 | A * | 9/1994 | Kamijo et al. | 399/120 |
| 5,617,579 | A * | 4/1997 | Yashiro et al. | 399/114 |
| 5,689,774 | A * | 11/1997 | Shishido et al. | 399/111 |
| 5,774,766 | A * | 6/1998 | Karakama et al. | 399/111 |
| 5,839,028 | A * | 11/1998 | Nomura et al. | 399/109 |
| 5,884,124 | A * | 3/1999 | Karakama et al. | 399/123 |
| 5,943,528 | A * | 8/1999 | Akutsu et al. | 399/111 X |
| 6,029,031 | A * | 2/2000 | Yokomori et al. | 399/109 |
| 6,163,666 | A * | 12/2000 | Hosokawa et al. | 399/111 |
| 6,408,142 | B1 * | 6/2002 | Takeuchi et al. | 399/13 |
| 6,643,482 | B2 * | 11/2003 | Higeta et al. | 399/109 |
| 6,856,775 | B2 * | 2/2005 | Sekine | 399/109 |
| 7,548,711 | B2 * | 6/2009 | Ziegelmuller et al. | 399/123 |
| 2009/0245853 | A1 * | 10/2009 | Lewis et al. | 399/106 |

* cited by examiner

*Primary Examiner* — Sandra Brase

(74) *Attorney, Agent, or Firm* — Jackson IPG PLLC

(57) ABSTRACT

The present invention relates to a processing cartridge, comprising a developing unit and a photosensitive unit, of which the latter consists of a photosensitive member and a developer chamber and has a developer outlet connecting the chamber and a sealing cap matching the developer outlet and used to seal the said outlet. Based on the said technical proposal, the photosensitive unit is designed with a developer outlet connecting the chamber and with a sealing cap matching the developer outlet and used to seal the said outlet, so, when the photosensitive unit becomes full with developer, the sealing cap can be opened to remove the developer in the photosensitive unit, which facilitates the cleaning without affecting the normal operation of the processing cartridge.

5 Claims, 3 Drawing Sheets

PROCESSING CARTRIDGE

BACKGROUND OF THE INVENTION

1. Field of the Invention

The invention relates to an electrophotographic image forming device, such as a laser printer, copier, facsimile machine, etc. Particularly, the invention relates to a processing cartridge for the electrophotographic image forming device.

2. Description of the Related Art

A conventional processing cartridge, as illustrated in FIG. 1, comprises a developing unit 1, a photosensitive unit 2, a first side plate 3, a second side plate 4 and a sealing plug 5. The developing unit 1 comprise at least a case 8 and a developing member 7; the photosensitive unit 2 comprise at least a photosensitive member (not indicated); the first side plate 3 and the second side plate 4 are respectively mounted on both ends of the developing unit 1 and are used to support the developing member 7. The developing unit 1 can store developer and has also a developer inlet 6, through which the developer enters and is stored in the developing unit 1. The developer inlet 6 is closed with the sealing plug 5 after the developer is stored in the developing unit 1, and then, one end of the case 8, at least including the sealing plug 5, is covered by the first side plate 3 and the other end of the case is covered by the second side plate 4. Finally, the developing unit 1 mounted with the first side plate 3, the second side plate 4 and the sealing plug 5, and the photosensitive unit 2 will be assembled together.

When the electrophotographic image forming device operates, it receives external signals for an electrostatic latent image to be formed on the photosensitive member in the photosensitive unit 2 on the processing cartridge. Afterwards, the processing cartridge receives the driving power and voltage from the electrophotographic image forming device to output the developer, as stored in the developing unit 1 on the processing cartridge, to the developing member 7, and a developer layer will be formed on the developing member 7. The developer layer develops the electrostatic latent image on the photosensitive member in the photosensitive unit 2 and then the electrophotographic image forming device transfers the developed electrostatic latent image onto a printing medium.

Some of the transferred developer will remain on the photosensitive member due to incomplete transfer and finally be cleaned down into the photosensitive unit 2 and stored in the chamber 2*a* as shown in FIG. 2. The chamber 2*a* has many ribs in it for enhancing the strength thereof.

After the processing cartridge reaches a certain point of its useful life, the photosensitive unit will be filled up with the developer cleaned down from the photosensitive member and cannot store developer any more. If the processing cartridge continues to operate, the residual developer on the photosensitive member could not be cleaned up, which therefore affects the normal operation of the processing cartridge.

SUMMARY OF THE INVENTION

It is, inter alia, an object of the invention to provide a processing cartridge aiming at tackling the technical problem that the photosensitive unit of a conventional processing cartridge, after filled up with the developer cleaned down from the photosensitive member of the processing cartridge, can no longer store developer, which affects the normal operation of the processing cartridge for the residual developer on the photosensitive member could not be cleaned up.

To that end, the invention adopts a technical proposal as follows:

A processing cartridge, comprising a developing unit and a photosensitive unit, the photosensitive unit comprising a photosensitive member and a chamber for developer, characterized in that said photosensitive unit also comprises a developer outlet connecting the chamber and a sealing cap matching the developer outlet and used to seal said outlet.

The processing cartridge also includes a first side plate on one end of the developing unit comprising a case and a developing member. A developer inlet is designed on the developing unit close to the first side plate. The developer inlet is sealed by means of a sealing plug. The first side plate has an opening designed to expose the sealing plug at a position corresponding to the sealing plug.

In addition, said photosensitive unit has a third side plate used to secure one end of the photosensitive unit.

Said chamber has ribs. Said ribs are designed with grooves.

Said photosensitive unit includes also a second side plate, mounted on the other end of the developing unit and used to support the developing member.

Based on said technical proposal, the photosensitive unit has a developer outlet connecting the chamber and a sealing cap matching the developer outlet and used to seal the said outlet. Thus, when the photosensitive unit is filled up with developer, the sealing cap can be opened to pour away the developer in the photosensitive unit, which makes it easy to clean without affecting the normal operation of the processing cartridge and solves the technical problem that the photosensitive unit of a conventional processing cartridge, after filled up with the developer cleaned down from the photosensitive member of the processing cartridge, can no longer store developer, which affects the normal operation of the processing cartridge for the residual developer on the photosensitive member could not be cleaned up. Then again, there are grooves designed on the ribs in the chamber, so the developer can flow freely between the ribs in the chamber via the grooves, making it easier and more convenient to store and pour out the developer. At the last, since the first side plate has an opening designed to expose the sealing plug at the position corresponding to the sealing plug, it is good to only remove the sealing plug from the opening without opening the first side plate when refilling developer, which further facilitates the refilling of developer.

DESCRIPTION OF PREFERRED EMBODIMENTS

Figure 1:
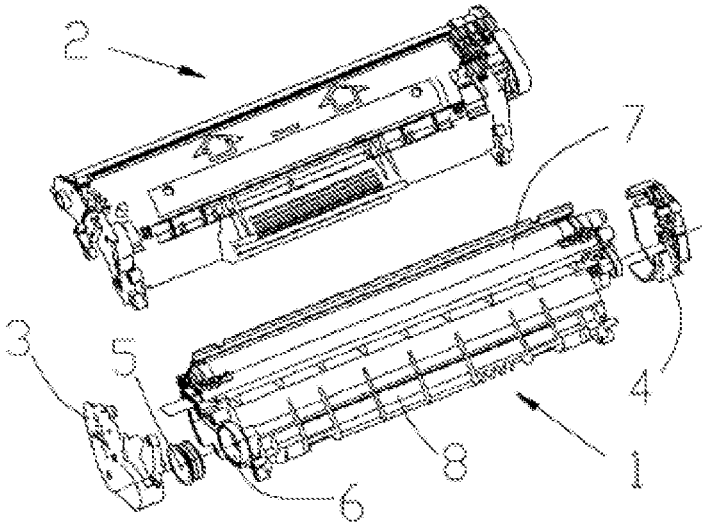
Fig. 1 (Prior Art)
FIG. 1 illustrates the spatial structure of a conventional processing cartridge.
Figure 2:
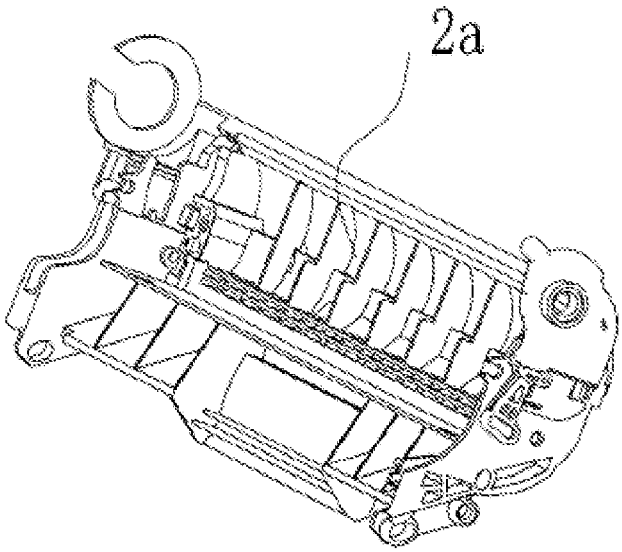
Fig. 2 (Prior Art)
FIG. 2 illustrates the internal structure of the chamber in a conventional processing cartridge.
Figure 3:
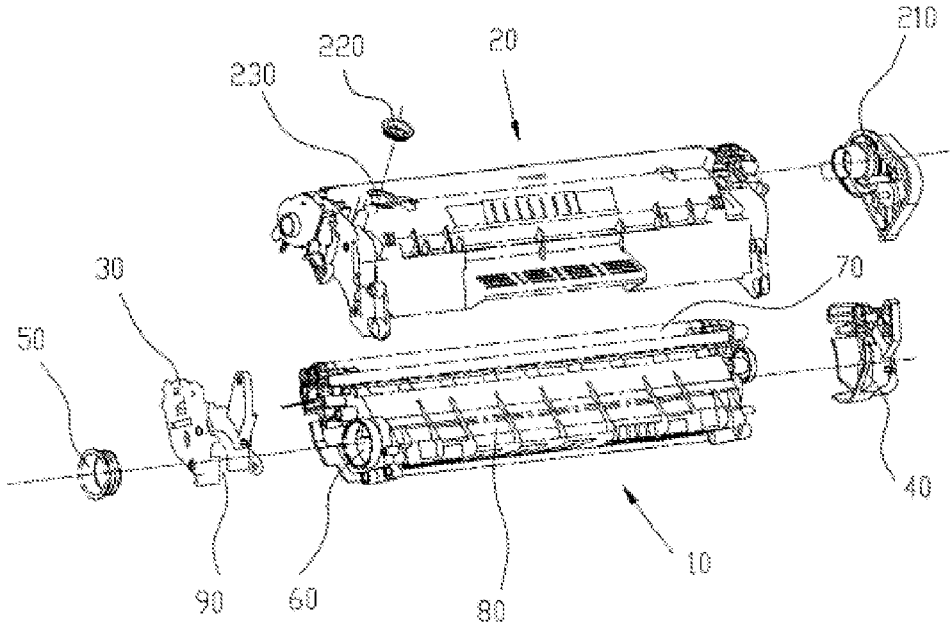
FIG. 3 illustrates the detailed structure of a processing cartridge of the present invention.

A processing cartridge, as shown in FIG. 3, comprises a developing unit 10 and a photosensitive unit 20, the developing unit 10 comprise at least a sealing plug 50, a first side plate 30, a case 80, a developing member 70 and a second side plate 40, the photosensitive unit 20 consists at least of a photosensitive member (not indicated), a third side plate 210 and a sealing cap 220, and said sealing cap 220 is round.

The first side plate 30 is mounted on one end of the case 80 and the second side plate 40 is mounted on the other end of the same case. The developing member 70 is mounted on the case 80 and is fixed by the first side plate 30 and the second side plate 40. The third side plate 210 is mounted on one end of photosensitive unit 20 to secure one end of the photosensitive member in the photosensitive unit 20.

A developer inlet 60 is designed on the case 80. The developer enters via the developer inlet 60, and is stored in, the developing unit 10.

Figure 4:
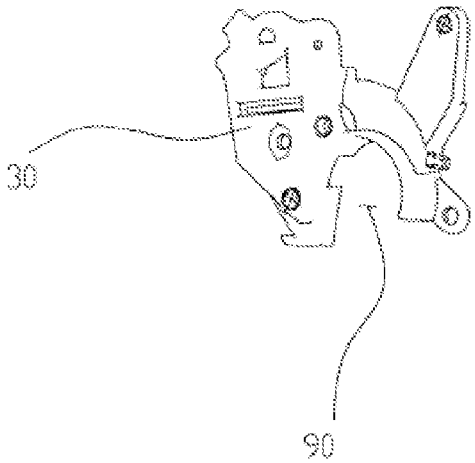
FIG. 4 illustrates the spatial structure of the first side plate in the processing cartridge of the present invention.
Figure 5:
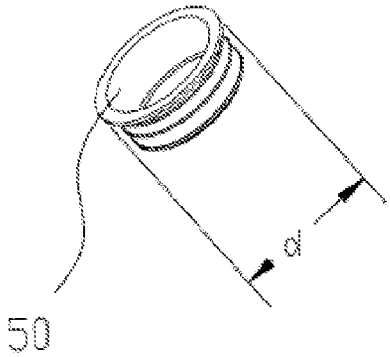
FIG. 5 illustrates the spatial structure of the sealing plug in the processing cartridge of the present invention.

As shown in FIG. 4 and FIG. 5, the first side plate 30 has a sealing plug opening 90, whose minimum size is slightly greater than the maximum diameter of the sealing plug 50. When the developing unit 10 is filled up with developer, the sealing plug 50 seals the developer inlet 60 on the case 80 through the opening 90 on the first side plate 30 as said first side plate 30 is mounted on the case 80, thus seals the developer in the developing unit 10.

Figure 6:
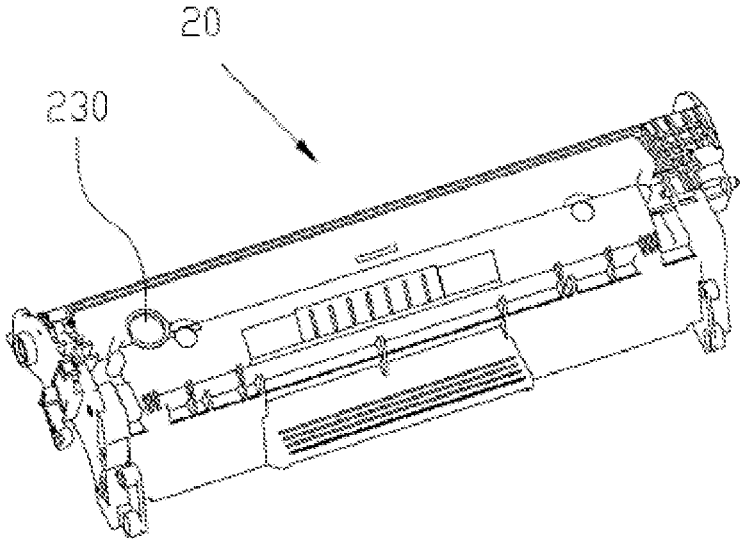
FIG. 6 illustrates the spatial structure in the processing cartridge of the present invention, with the sealing cap opened.
Figure 7:
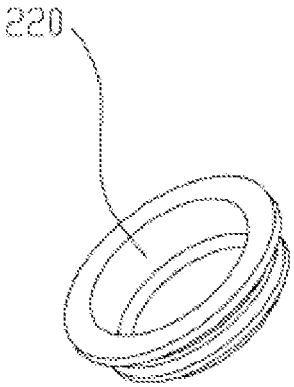
FIG. 7 illustrates the spatial structure of the sealing cap in the processing cartridge of the present invention.

As shown in FIG. 6 and FIG. 7, the photosensitive unit 20 has a developer outlet 230. The sealing cap 220 can close the said developer outlet 230. When the sealing cap 220 is opened, the developer can flow out of photosensitive unit 20 via the developer outlet 230.

When the developer in the developing unit 10 is used up, it is practicable to refill the developing unit 10 with developer, if required, just by opening the sealing plug 50.

If the photosensitive unit 20 becomes full with developer, the sealing cap 220 can be opened to remove the developer in the photosensitive unit 20.

Figure 8:
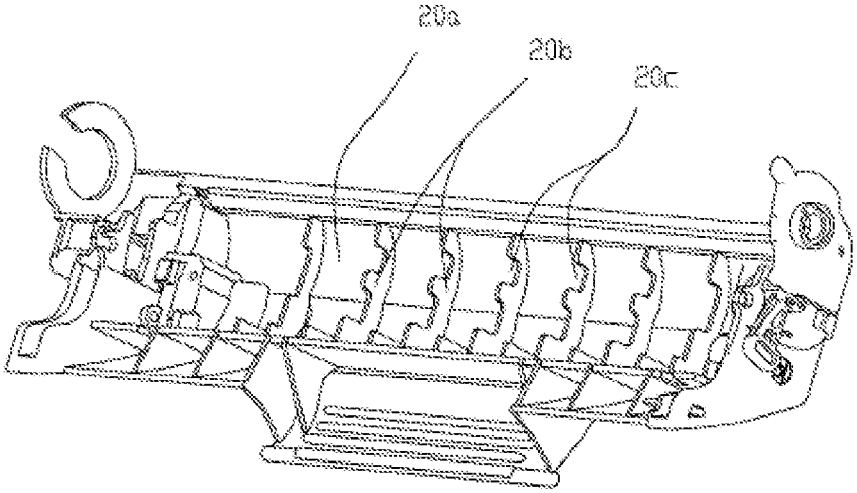
FIG. 8 illustrates the internal structure of the chamber in the processing cartridge of the present invention.

As shown in FIG. 8, the photosensitive unit 20 has a chamber 20*a*, used to store developer. The said chamber 20*a* has, inside, at least one rib 20*b*, on which there is at least one groove 20*c*. The developer can flow freely in the chamber 20*a* via the groove 20*c*, enabling the developer to completely flow out of the developer outlet 230.

After the processing cartridge is mounted onto an electronphotographic image forming device, the developer is transferred to the developing member 70 under the action of the voltage and driving force supplied by the electrophotographic image forming device. After the electrophotographic image forming device receives external signals, an electrostatic latent image will be formed on the photosensitive member. The developer as absorbed on the developing member 70 develops the said electrostatic latent image, resulting in a developer image corresponding to the said electrostatic latent image. Subsequently, the developer image will be transferred onto a printing medium.

Some developer will remain absorbed on the photosensitive member due to incomplete transfer and finally be cleaned down and stored in the chamber 20*a* on the photosensitive unit 20.

What is claimed is:

1. A processing cartridge, comprising:
a developing unit and
a photosensitive unit,
the photosensitive unit comprising:
a photosensitive member and
a chamber for residual developer,
said chamber having a plurality of ribs arranged along a longitudinal axis of an interior surface of said chamber, said ribs extending less than half of a transverse axis of said chamber for residual developer,
each rib having one or more grooves in it characterized in that said photosensitive unit also comprises a developer outlet connecting the chamber and a removable sealing cap matching the developer outlet and used to seal said outlet.

2. The processing cartridge as claimed in claim 1, characterized in that
the processing cartridge also includes a first side plate on one end and
a second side plate on an opposite end of the developing unit comprising
a case and
a developing member,
a developer inlet designed on the developing unit close to the first side plate,
the developer inlet sealed by means of a sealing plug,
the first side plate has an opening designed to expose the sealing plug at a position corresponding to the sealing plug.

3. The processing cartridge as claimed in claim 1, characterized in that
the said photosensitive unit also includes a third side plate used to secure one end of the photosensitive unit.

4. The processing cartridge as claimed in claim 1, characterized in that
said grooves on said ribs in said chamber for residual developer have a height defined as a distance between a bottom of said rib and an opening of said rib, and
said grooves on said ribs in said chamber for residual developer have a width defined as a distance between a sidewall of said rib to a second sidewall of said rib, and
said width is equal to or larger than said height.

5. The processing cartridge as claimed in claim 1, characterized in that
one or more of said ribs in said chamber for residual developer has two or more grooves in it.

* * * * *